US006447204B1

(12) United States Patent
McDonald

(10) Patent No.: US 6,447,204 B1
(45) Date of Patent: Sep. 10, 2002

(54) MULTIPLE IMPLEMENT SCREED

(76) Inventor: Lowell McDonald, 2908 E. 61st St. N., Wichita, KS (US) 67219

( * ) Notice: Subject to any disclaimer, the term of this patent is extended or adjusted under 35 U.S.C. 154(b) by 0 days.

(21) Appl. No.: 09/939,929

(22) Filed: Aug. 27, 2001

(51) Int. Cl.[7] ..... E01C 19/00
(52) U.S. Cl. ..... 404/118; 404/841
(58) Field of Search ..... 404/84.1, 84.2, 404/84.5, 84.8, 96, 103, 114, 118

(56) References Cited

U.S. PATENT DOCUMENTS 4,802,293 A * 2/1989 Smith ..... 172/787 X
5,353,063 A * 10/1994 Allen et al. ..... 404/84.1
6,227,761 B1 * 5/2001 Kieranen et al. ..... 404/84.5

FOREIGN PATENT DOCUMENTS

JP 11269816 * 11/1999

OTHER PUBLICATIONS

Internet article, "Somero Enterprises" brochure, (5 pages), date 2000.*

* cited by examiner

*Primary Examiner*—Heather Shackelford
*Assistant Examiner*—Sunil Singh
(74) *Attorney, Agent, or Firm*—Kenneth Jack

(57) ABSTRACT

A screed consisting of a screeding implement suspension frame; a first screeding implement having a first grading blade attached to a forward end of the screeding implement suspension frame so that a lower end of the first grading blade extends downwardly to a first elevation; a second screeding implement attached to the screeding implement suspension frame rearwardly from the first grading blade so that a lower end of the second screeding implement extends downwardly to a second elevation below the first elevation; a second grading blade; and spirally threaded nuts and bolts removably attaching the second grading blade to the first grading blade so that the lower end of the second grading blade extends downwardly below the second elevation; a third screeding implement attached to the screeding implement suspension frame rearwardly of the second screeding implement.

6 Claims, 3 Drawing Sheets

MULTIPLE IMPLEMENT SCREED

FIELD OF THE INVENTION

This invention relates to multiple implement screeds. More particularly, this invention relates to adaptations of such screeds for enhanced loose material grading.

BACKGROUND OF THE INVENTION

Multiple implement screeds such as those manufactured by Somero Enterprises, Inc., of Houghton, Mich., typically comprise a forward loose material grading plow or blade followed by one or more screeding implements mounted to the rear of the forward grading blade. Typically, the working surfaces of such screeding implements mounted to the rear of such forward grading blade are positioned at successively lower elevations with respect to the lower lip of the forward grading blade. Such arrangements of the forward grading blade and rearwardly installed screeding implements restricts the functionality and usefulness of the forward grading blade. For example, concrete slab floors are commonly poured over a base layer of sand. It is often desirable to level and smooth the base layer of sand prior to pouring of concrete thereover. A loose material grading plow or blade similar to that which is commonly installed as the forward implement of a multi-implement screed, is typically utilized for leveling and smoothing of such base sand layers. However, the relatively high elevation of the lower edge of the grading blade of a multi-implement screed undesirably prevents such blade from being utilized for screeding such base layers of sand.

The instant inventive screed solves such deficiency by providing a second removably attachable grading blade. Provision and attachment of such blade allows a common multi-implement screed to be alternately utilized for sand or other loose material grading.

BRIEF SUMMARY OF THE INVENTION

A primary structural component of the instant inventive multi-implement screed comprises a laterally oblongated implement suspension frame having a first material grading blade fixedly attached to and extending downwardly from its forward end. Considering such first grading blade as being a first screeding implement, a second screeding implement is fixedly attached to the screeding implement suspension frame so that it extends downwardly therefrom, and so that it is positioned rearwardly from the first grading blade. The second screeding implement may consist of any of several commonly known screeding implements such as helical bladed material conveyors, flanged conveyors, flat trowels, vibratory trowels, surface scoring trowels, and rollers. Preferably, the elevation of the lower working surface of the second screeding implement is below the elevation of the first grading blade. Suitably, a third screeding implement selected from the group described above may similarly be installed to the rear of the second screeding element, the elevation of the lower working surface of the third screeding implement preferably being at or below the elevation of the lower working surface of the second screeding implement.

A second material grading blade is necessarily provided, such blade preferably having a vertical dimension such that upon attachment to the lower edge of the first grading blade, the lower edge of the second grading blade extends downwardly to an elevation below the working surfaces of each of the other screeding implements. Removable attaching means are necessarily provided for attaching the second material grading blade to the first material grading blade, such means preferably comprising combinations of spirally threaded bolts or lugs and nuts. Spirally threaded nut and bolt combinations, spirally threaded screws, slip sleeve and slip pin combinations, eye and pin combinations, pin and device combinations, and quick disconnect couplings may be suitably alternately utilized as means for removably attaching the second material grading blade to the first material grading blade.

In use of the present inventive multiple implement screed, the implement may be driven or drawn through an uneven layer of base sand, desirably smoothing and leveling the sand layer in preparation for concrete pouring. Thereafter, concrete may be poured, and the second material grading blade may be removed, allowing the multiple implement screed to smooth and level the concrete.

Accordingly, it is an object of the present invention to provide a multiple implement screed which is capable of alternately functioning independently as a loose material grading blade.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
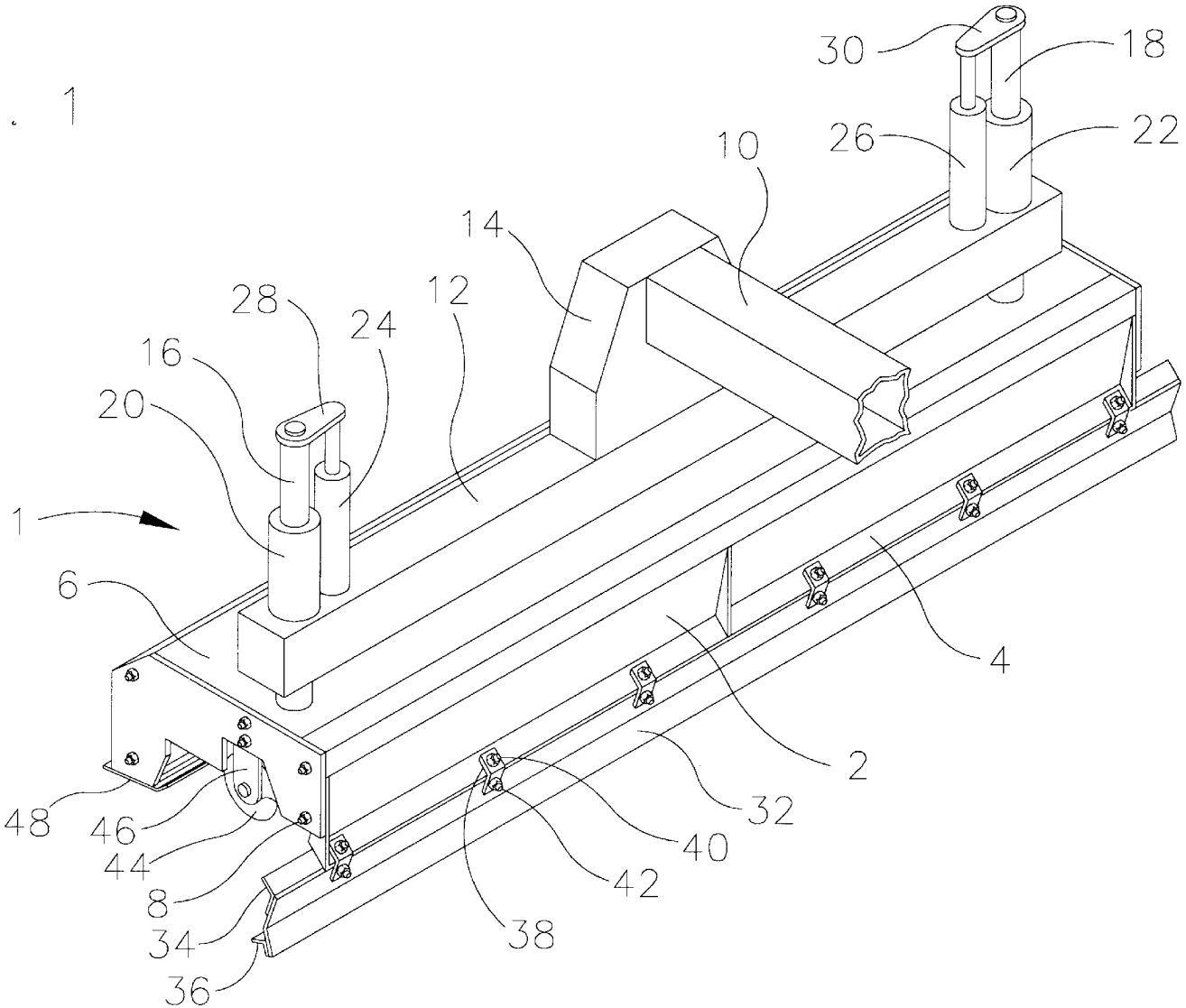
FIG. 1 is an isometric view of a preferred embodiment of the instant inventive multiple implement screed.

Referring now to the drawings, and in particular to FIG. 1, the present inventive multi-implement screed is referred to generally by reference arrow 1. A major structural component of the screed 1 comprises a laterally oblongated implement suspension frame 6, such frame being positionably suspended by slide posts 16 and 18. Slide posts 16 and 18 extend through a "T" beam 12 and through slide collars 20 and 26 for adjustable vertical positioning via hydraulic cylinders 24 and 26 and couplings 28 and 30. "T" beam 12 is fixedly attached to an extendable and retractable boom arm 10 by coupling 14. In use, the multi-implement screed 1 is suspended by boom arm 10 and is thereby drawn or pulled, allowing suspended material working implements to smooth materials such as sand or freshly poured concrete. Actuation of rams 24 and 26 provides precise control of the level and orientation of the multi-implement screed 1.

Figure 2:
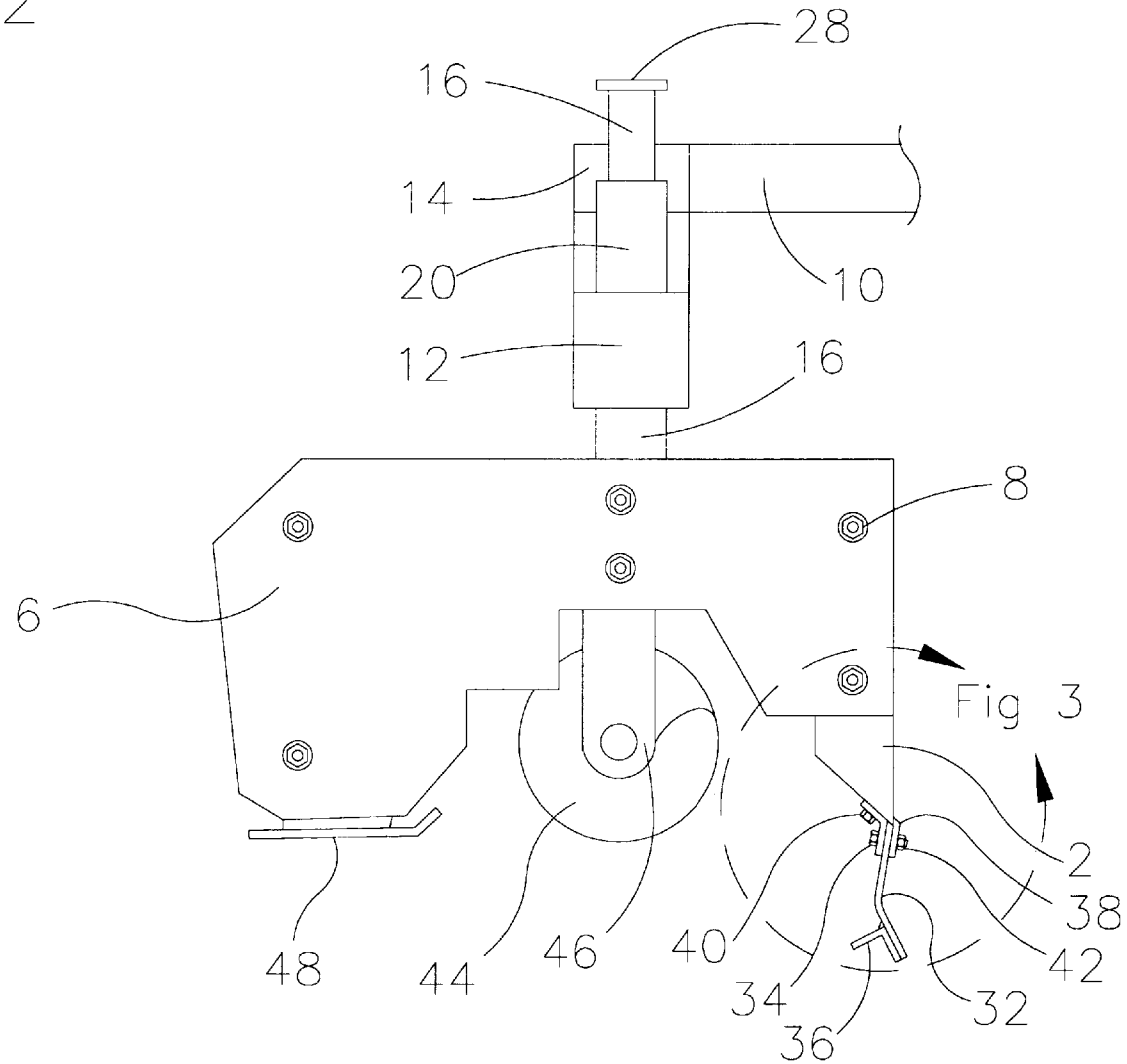
FIG. 2 is a side view of the implement depicted in FIG. 1.

Referring simultaneously to FIGS. 1 and 2, a first grading blade 2 having a lower lip 4 is fixedly attached to the forward end of the implement suspension frame 6 by means of spirally threaded nuts and bolts 8. The lower lip 4 of the first grading blade 2 extends downwardly from the implement suspension frame 6 to a first elevation with respect to implement suspension frame 6.

Referring further simultaneously to FIGS. 1 and 2, second and third material screeding implements depicted as a helical bladed auger 44 rotatably mounted by axle mounts 46 and, depicted as a vibratory trowel 48 are fixedly suspended from the suspension frame 6. As can be seen in the side view of FIG. 2, the lower material working surface of helical auger 44 has an elevation below that of the lower lip of the first grading blade 2. Similarly, the lower material working surface of vibratory trowel 48 has an elevation at or below that of the layer material working surface of helical auger 44. Alternately, material screeding implements such as rollers, flanged material conveyors, fixed flat trowels, and scoring trowels, all not depicted, may be suitably utilized in place of the depicted vibratory trowel 48 and helical auger 44.

Referring simultaneously to FIGS. 1 and 2, upon detachment of a second material grading blade 32, the multi-implement screed 1 may be forwardly drawn over freshly poured concrete. Such drawing action causes the first material grading blade 2 to first come into contact with the concrete, forwardly skimming away undesirable accumulations and upward protrusions of the concrete. Upon such forward drawing action, the helical auger 44 next engages the fresh concrete, drawing a thin upper layer of the concrete sidewise for filling of any undesirable depressions or voids. The vibratory trowel 48 next engages the freshly poured concrete, finally smoothing the concrete. While the successively downward progression of elevations of the working surfaces of the first grading blade 2, the helical auger 44, and the vibratory trowel 48 facilitates and enhances the multi-implement screed's ability to level and smooth freshly poured concrete, such downward progression of elevations tends to interfere with the screed's ability to level and smooth other loose materials such as sand. Adaptation of the multi-implement screed 1 to include the removably attached second grading blade 32 allows the multi-implement screed 1 to further perform the function of grading and smoothing sand base layers which often underlie poured concrete slabs.

Figure 3:
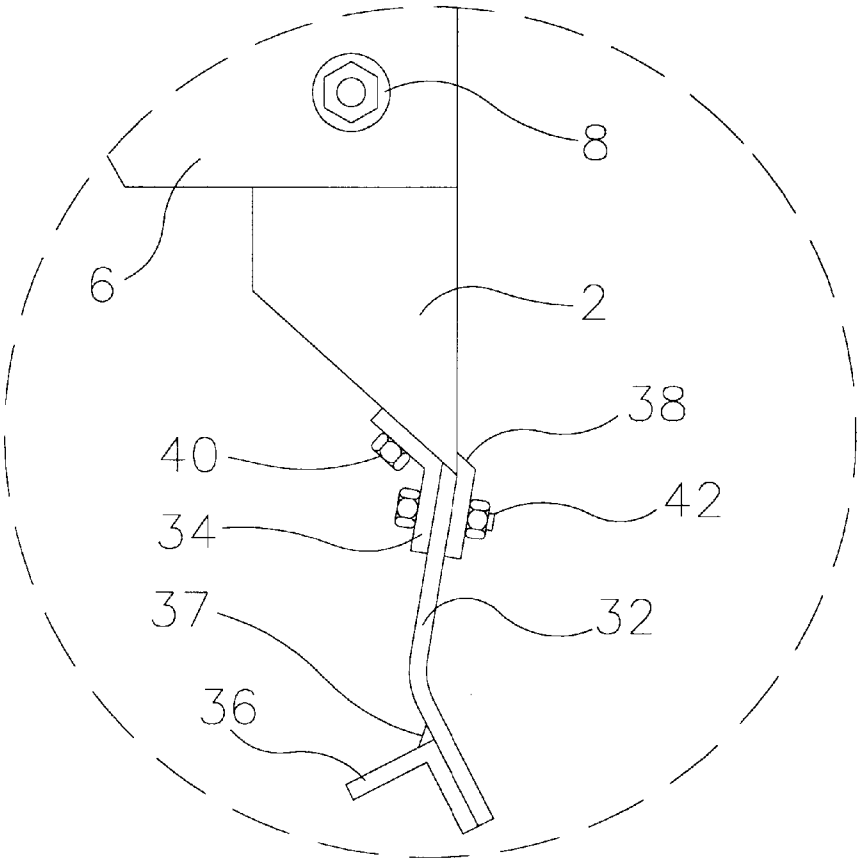
FIG. 3 is a magnified partial view of the implement depicted in FIG. 2.

Referring simultaneously to FIGS. 2 and 3, the second grading blade 32 is preferably fixedly and removably attached to the lower lip of first grading blade 2 by means of a backing angle iron 34 and a plurality of apertured tabs 38. The lower edge of first grading blade 2 and the upper edge of second grading blade 32 are necessarily apertured for receipt of spirally threaded nut and bolt combinations 40 and 42. Alternately, spirally threaded lugs (not depicted) may be fixedly welded to angle iron 34. Preferably, a second angle iron 36 is fixedly attached to the rearward surface of second grading blade 32 at its lower end by means of a heat fusion weld 37, such angle iron serving to stiffen and reinforce the second grading blade 32. Other blade mounting means such as slip sleeve and slip pin combinations, eye and pin combinations, pin and clevice combinations, and quick disconnect couplings, all not depicted, may be suitably utilized for removably attaching the second grading blade 32 to the lower end of first grading blade 2. The second grading blade 32 necessarily has a vertical dimension or height such that upon removable attachment to the lower end of the first grading blade 2, the lower material working edge of second grading blade 32 extends downwardly to an elevation below that of each of the lower working surfaces of the rearwardly installed material screeding implements.

Referring simultaneously to all figures, in use of the present inventive multi-implement screed 1, the second lower grading blade 32 is attached while the screed is utilized for smoothing loose material such as sand base layers. Where the multi-implement screed 1 is to be utilized for smoothing materials such as freshly poured concrete, the second grading blade 32 is removed and set aside.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A screed comprising:

(a) a screeding implement suspension frame having a forward end;

(b) a first screeding implement comprising a first grading blade having a lower end, the first grading blade being fixedly attached to the forward end of the screeding implement suspension frame, the lower end of the first grading blade extending downwardly from the screeding implement suspension frame to a first elevation;

(c) a second screeding implement having a lower end, the second screeding implement being fixedly attached to the screeding implement suspension frame, the second screeding implement being positioned rearwardly from the first grading blade, the lower end of the second screeding implement extending downwardly from the screeding implement suspension frame to a second elevation, the second elevation being lower than the first elevation;

(d) a second grading blade having a lower end; and (e) blade mounting means capable of removably attaching the second grading blade to the first grading blade, the blade mounting means interconnecting the first and second grading blades so that the lower end of the second grading blade extends downwardly from the first grading blade to a third elevation, the third elevation being lower than the second elevation.

2. The screed of claim 1 wherein the second screeding implement is selected from the group of helical conveyors, vibratory trowels, flat trowels, surface scoring trowels, flanged conveyors, and rollers.

3. The screed of claim 2 wherein the blade mounting means comprises a fastener selected from the group of spirally threaded nut and bolt combinations, spirally threaded screws, slip sleeve and slip pin combinations, eye and pin combinations, pin and device combinations, and quick disconnect couplings.

4. The screed of claim 1 further comprising a third screeding implement having a lower end, the third screeding implement being fixedly attached to the screeding implement suspension frame, the third screeding implement being positioned rearwardly from the second screeding implement, the lower end of the third screeding implement extending downwardly from the screeding implement suspension frame to a fourth elevation, the fourth elevation being above the third elevation, the fourth elevation being at or below the second elevation.

5. The screed of claim 4 wherein the second and third screeding implements are selected from the group of flanged conveyors, helical conveyors, flat trowels, vibratory trowels, surface scoring trowels and rollers.

6. The screed of claim 5 wherein the blade mounting means comprises a fastener selected from the group of spirally threaded nut and bolt combinations, spirally threaded screws, slip sleeve and slip pin combinations, eye and slide bolt combinations, pin and device combinations, and quick disconnect couplings.

* * * * *